US007225508B2

(12) United States Patent
Chou

(10) Patent No.: US 7,225,508 B2
(45) Date of Patent: Jun. 5, 2007

(54) SHUT APPARATUS

(75) Inventor: Chao-Mu Chou, Taipei (TW)

(73) Assignees: Ching-Yu Chou, Taipei (TW); Shiu-Yin Cheng, Taoyuan Hsien (TW)

( * ) Notice: Subject to any disclaimer, the term of this patent is extended or adjusted under 35 U.S.C. 154(b) by 0 days.

(21) Appl. No.: 10/617,374

(22) Filed: Jul. 11, 2003

(65) Prior Publication Data

US 2004/0250383 A1 Dec. 16, 2004

(30) Foreign Application Priority Data

Jun. 16, 2003 (TW) ..... 92210931 U

(51) Int. Cl.
*A44B 19/16* (2006.01)

(52) U.S. Cl. ..... 24/400; 24/459; 24/570; 24/571; 24/586.1; 24/594.11; 24/DIG. 39; 24/DIG. 51; 383/63

(58) Field of Classification Search ..... 24/389, 24/304, 381, 585.1, 585.11, 584.1, 682.1, 24/683, 399, 400, 459, 487, 517–520, 570, 24/571, 586.1, 586.11, 594.11, DIG. 39, 24/DIG. 41, DIG. 50, DIG. 51; 16/87.2; 383/5, 63, 65; 261/94
See application file for complete search history.

(56) References Cited

U.S. PATENT DOCUMENTS 509,129 A * 11/1893 Johnson ..... 24/135 N
822,313 A * 6/1906 Stevens ..... 24/115 G
1,125,067 A * 1/1915 Cook ..... 24/115 G
2,039,887 A * 5/1936 Colletti ..... 383/63
3,176,364 A * 4/1965 Dritz ..... 24/304
3,490,109 A * 1/1970 Helmut ..... 24/389
3,874,037 A * 4/1975 Takamatsu ..... 24/389
4,148,115 A * 4/1979 Kobelt ..... 24/586.1
5,062,186 A * 11/1991 Rampolla et al. ..... 24/389
5,174,658 A * 12/1992 Cook et al. ..... 383/33
5,222,988 A * 6/1993 Riley ..... 24/713.6
5,836,057 A * 11/1998 Machfud ..... 24/400
5,953,796 A * 9/1999 McMahon et al. ..... 24/585.1
6,047,441 A * 4/2000 Moorman ..... 16/87.2
6,233,869 B1 * 5/2001 Dearo ..... 47/44
6,505,380 B1 * 1/2003 Bourgeois ..... 16/87.2

* cited by examiner

*Primary Examiner*—Jack W. Lavinder
(74) *Attorney, Agent, or Firm*—Troxell Law Office PLLC

(57) ABSTRACT

An elongated shut apparatus includes a primary plate and a follower plate with the inner sides thereof facing to each other. Both the primary and the follower plate are made of soft high molecular material and have a concave shaped cross section with a thick central part getting thinner toward two lateral ends thereof.

10 Claims, 11 Drawing Sheets

SHUT APPARATUS

BACKGROUND OF THE INVENTION

1. Field of the Invention

The present invention relates to a kind of shut apparatus and particularly to a shut apparatus, which provides two engaging elements, being possible to be separated by foreign forces so as to actuate the operations of opening and shut.

2. Description of Related Art

The shut apparatus traditionally such as buttons, adhesive buckle belt or zippers is widely used in our daily lives and each of the preceding shut apparatus has its own specific feature.

In fact, the purpose and function of the shut apparatus pursued are easy to be operated and accurate to be opened and closed. Of course, the cost is one of factors has to be considered too. For some special fields, which are required to have the function such as water resistance, if the function of airtight and water resistance can be met effectively, the shut apparatus would become much more useful. Taking the conventional zipper as an example, it is really needed to meet the requirement of airtight and water resistance.

SUMMARY OF THE INVENTION

An object of the present invention is to provide an elongated shut apparatus, which includes a primary plate and a follower plate with the inner sides thereof facing to each other. Both the primary and the follower plate are made of soft high molecular material and have a concave shaped cross section, which has a thick central part extending toward two thin lateral ends in a way of getting thinner gradually, such that it is possible for the shut apparatus to enhance the effect of airtight so as to perform the function of airtight and water resistance.

BRIEF DESCRIPTION OF THE DRAWINGS

The present invention can be more fully understood by reference to the following description and accompanying drawings, in which:

FIG. 8-1 is a perspective view illustrating a slider for fitting with the shut apparatus according to the present invention;

FIG. 8-2 is a perspective view illustrating the slider shown in FIG. 8-1 having been outwardly fitted to the shut apparatus according to the present invention;

DETAILED DESCRIPTION OF THE PREFERRED EMBODIMENT

Referring to FIGS. 1 through 10, the shut apparatus according to the present invention basically includes a primary plate 1 and a follower plate 2.

Figure 9:
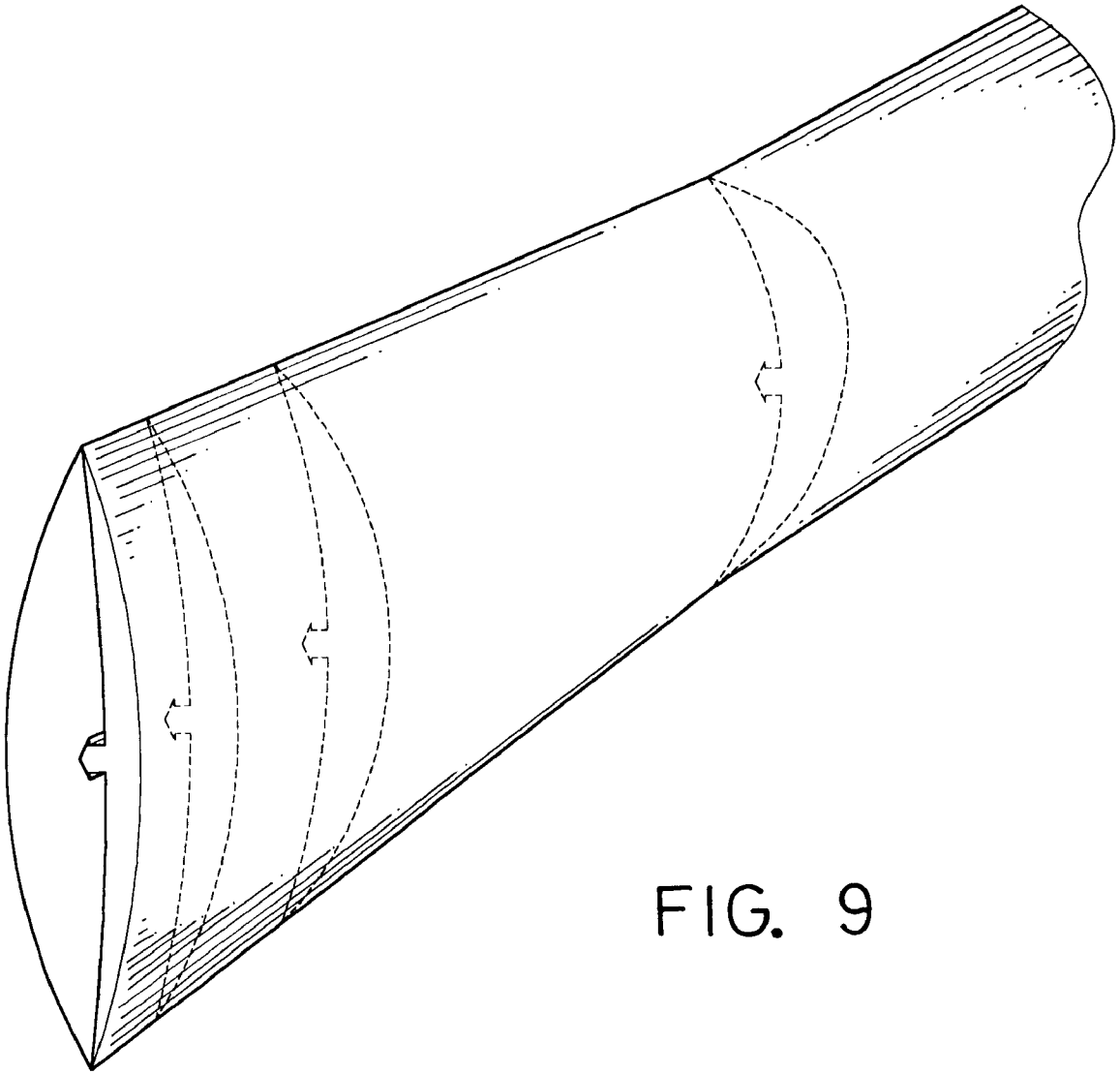
FIG. 9 is a perspective view illustrating the tail end of the shut apparatus according to the present invention being sealed.
Figure 10:
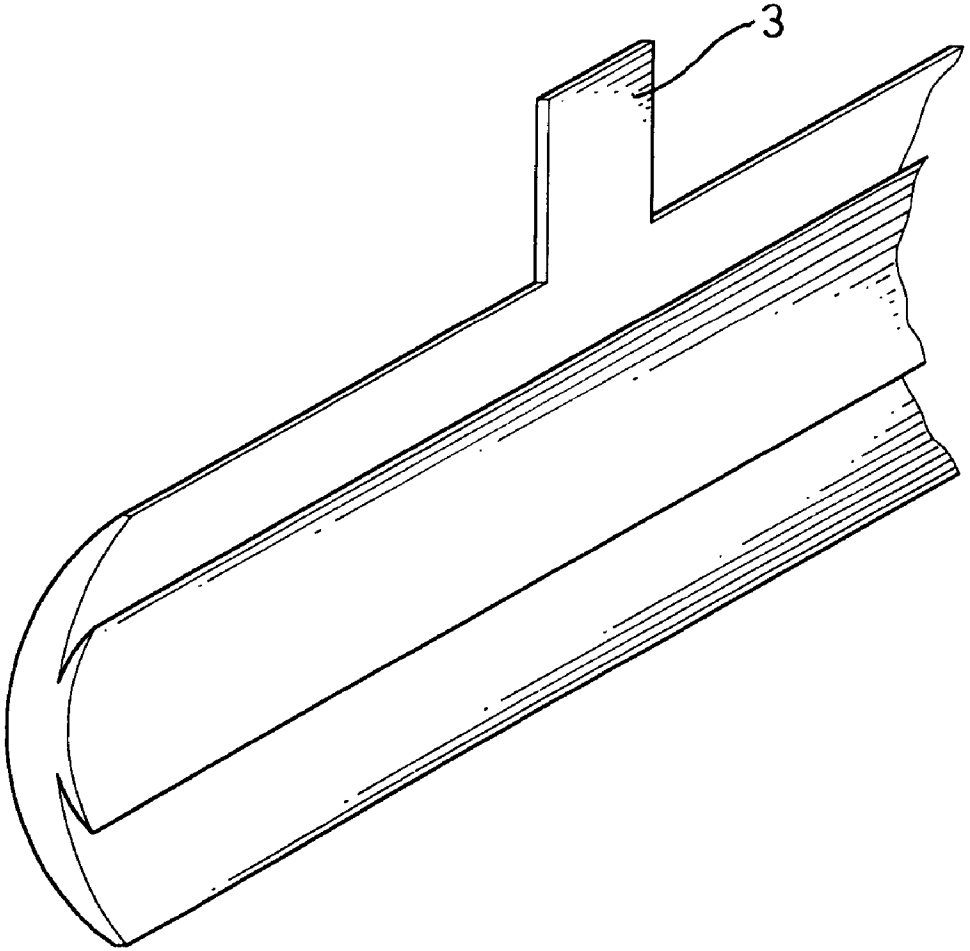
FIG. 10 is a perspective view illustrating a handle plate being added to the shut apparatus.

Wherein, the primary plate 1 and the follower plate 2 are made of soft material and oppositely disposed to each other so that it is preferable to have the cross sections thereof being identical with each other. Meanwhile, the two plates each at an end thereof are provided with a thickness getting thinner respectively so as to be tightly joined to each other as shown in FIG. 9. Further, the primary plate 1 or the follower plate 2 is provided with a handle plate 3 for facilitating to exert a force in case of the two plates 1, 2 being separated.

Figure 1:
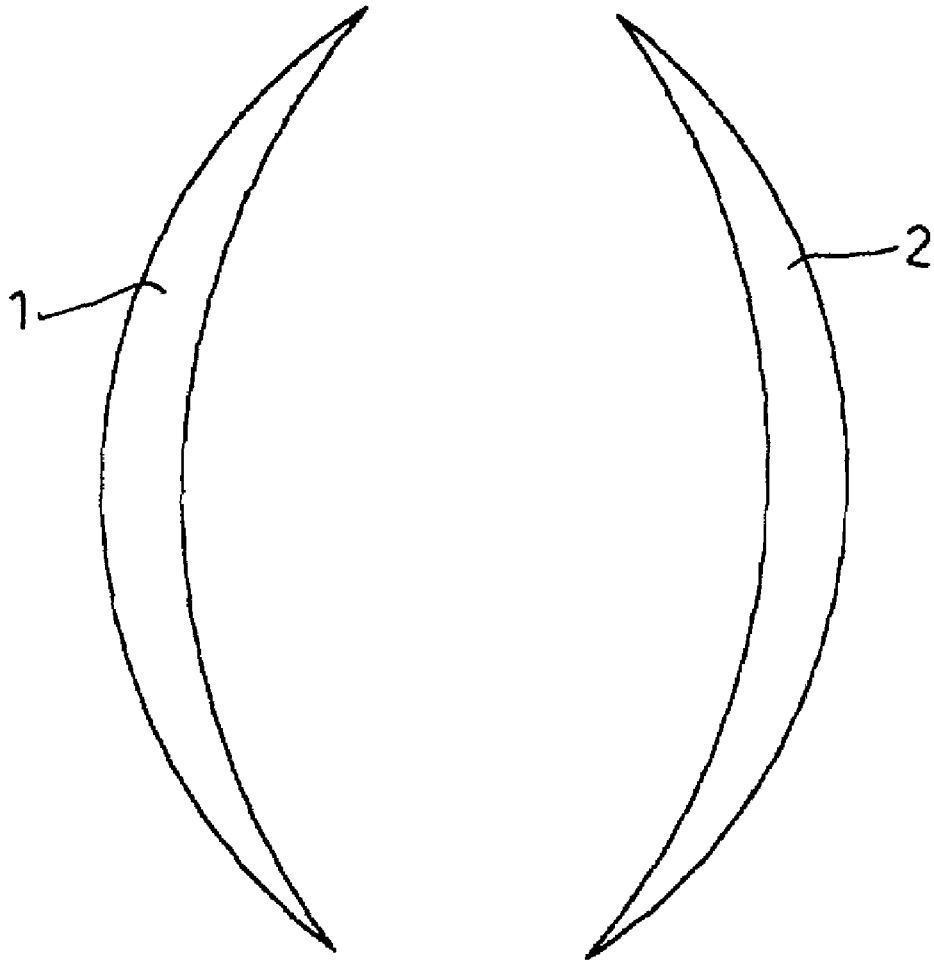
FIG. 1 is a plan view illustrating the cross section of a basic type shut apparatus according to the present invention.

In order to be secured in a state of tightening, the primary plate 1 and the follower plate 2, which have a concave shape respectively to face each other as shown in FIG. 1, can contact tightly at the inner sides thereof once the two plates 1, 2 are squeezed by a force from the outer sides thereof because of the two plates 1, 2 being made of soft material. In this way, the shut apparatus is formed, that is, an article is capable of being opened and closed in case of the primary plate 1 and the follower plate 2 are oppositely joined to the article and the magnitude of the joining force for the two plates 1, 2 is proportional to the contact area between the two plates 1, 2. Besides, in order to enhance the effect of airtight, the primary plate 1 and the follower plate 2 each have an inconsistent thickness, that is, each of the two plates 1, 2 has a thick central part and gets thinner toward two lateral ends thereof respectively.

Figure 2:
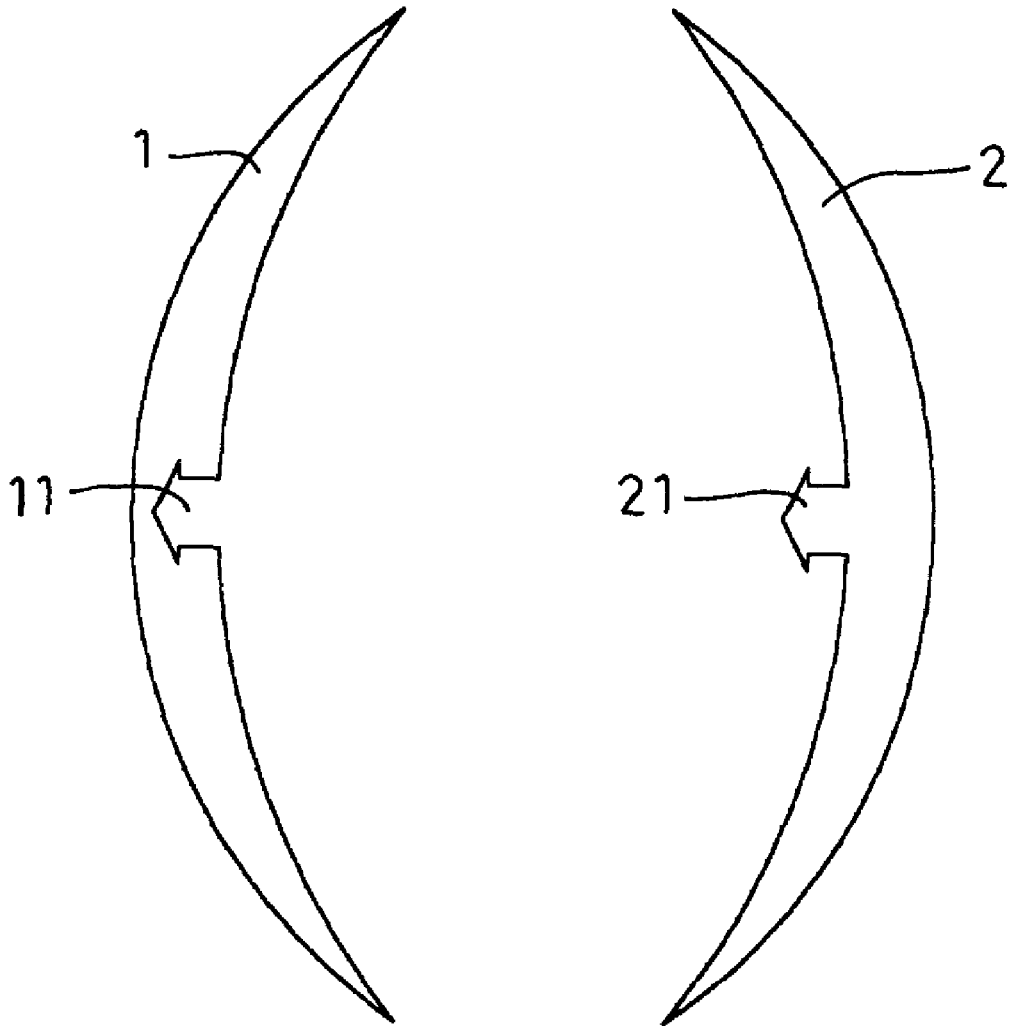
FIG. 2 is a plan view illustrating the basic type shut apparatus shown in FIG. 1 at inner sides thereof being added with secure device oppositely.

Referring to FIG. 2, the primary plate 1 and the follower plate 2 each have an engaging element 11, 12 respectively at the inner sides thereof. It can be seen in FIG. 2 that the engaging element 11 of the primary plate 1 can be a groove and the engaging element 21 of the follower plate 2 can be an elongated tenon so that the groove can fit with the tenon. Of course, the groove can be provided at the follower plate 2 and the tenon can be provided at the primary plate 1 instead. It is noted that engaging elements 11, 12 are not limited to the groove and the tenon and other types of fastening device can be used as well.

Figure 3:
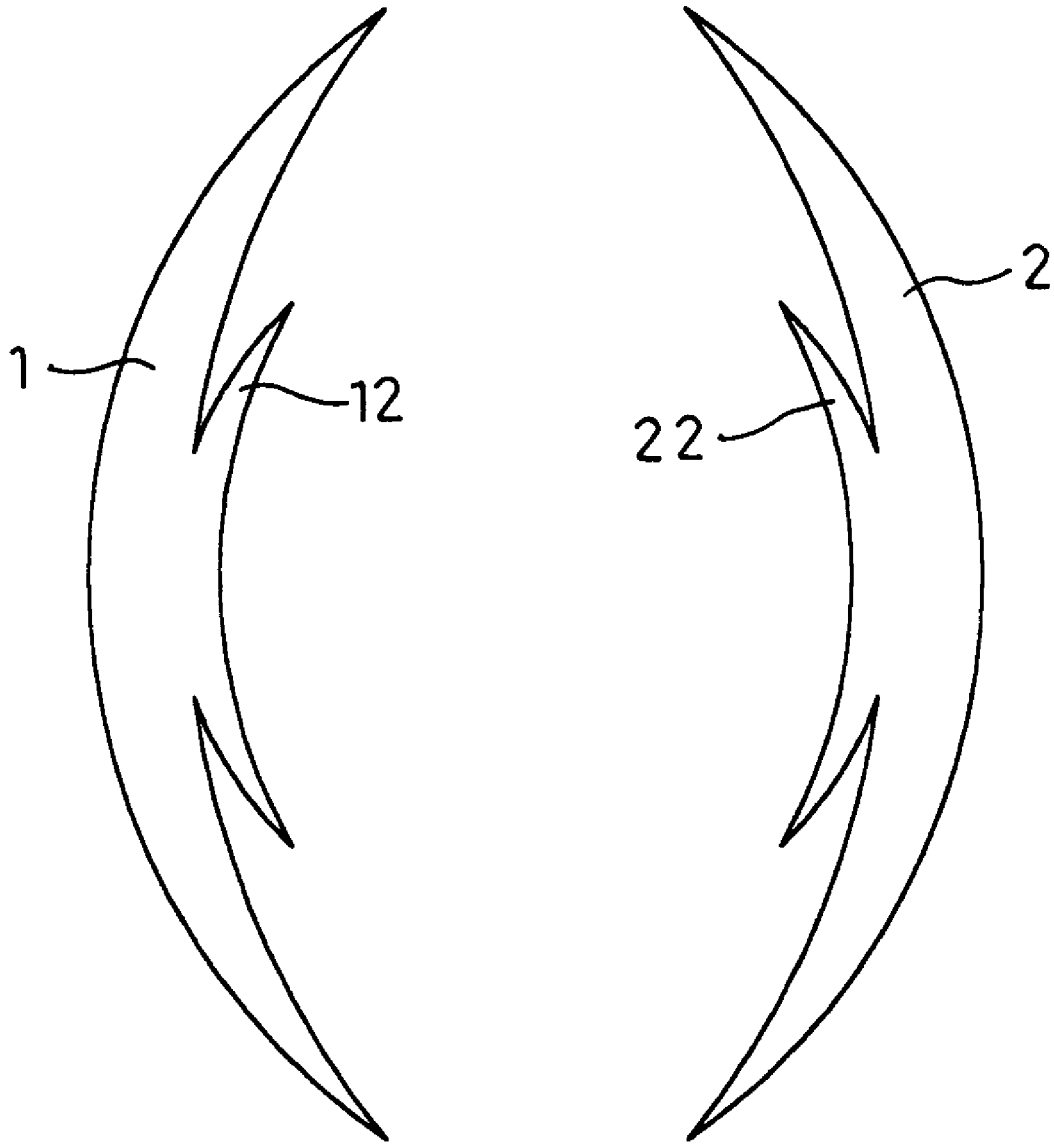
FIG. 3 is a plan view illustrating the basic type shut apparatus shown in FIG. 1 at inner sides thereof being added with multiple wings.

Referring to FIG. 3, the primary plate 1 and the follower plate 2 each can integrally extend a touch wing 12, 22 respectively at the inner sides thereof so that the touch wings 12, 22 can contact tightly to each other. Each of the touch wings 12, 22 has a concave shape with a thickness getting thinner toward two lateral ends from the central part thereof so that effect of double airtight can be obtained.

Figure 4:
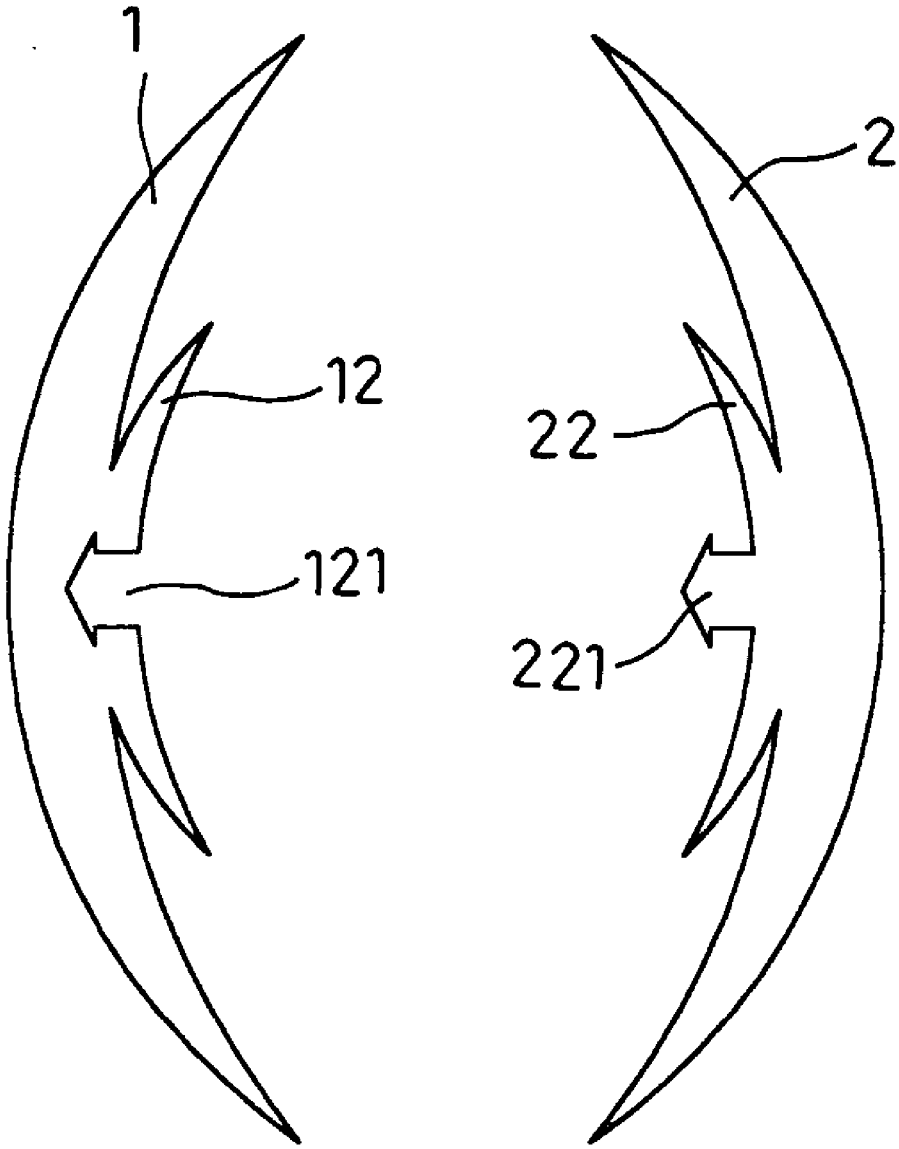
FIG. 4 is a plan view illustrating the basic type shut apparatus shown in FIG. 1 being added with secure device and multiple wings oppositely.

Referring to FIG. 4, the two touch wings 12, 22 shown in FIG. 3 are provided with an engaging element 121, 221 respectively to enhance the effect of engagement for the primary plate 1 and the follower plate 2.

Figure 5:
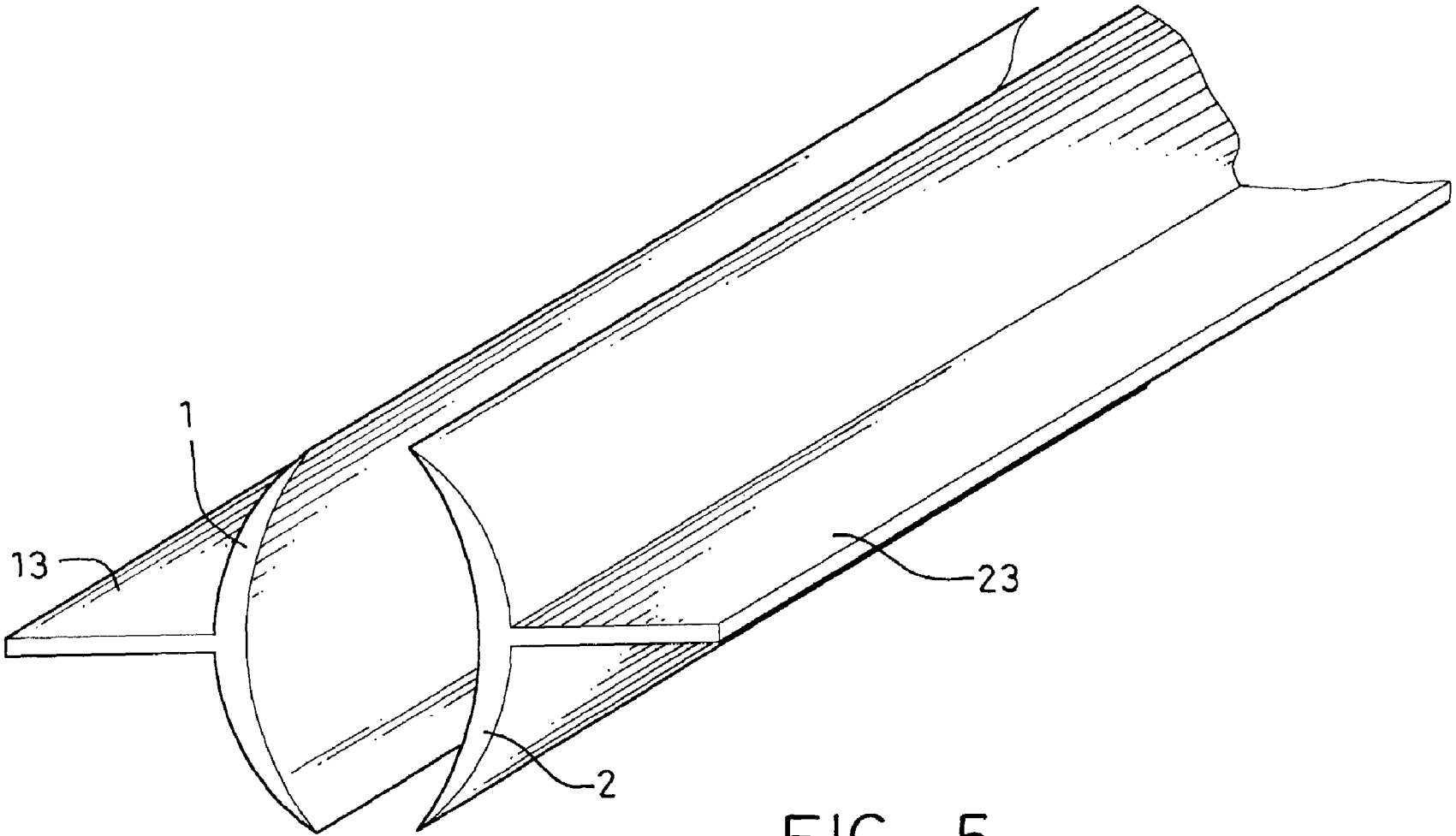
FIG. 5 is a perspective view of the shut apparatus according to the present invention illustrating horizontal joining plates being added to outer sides thereof.
Figure 6:
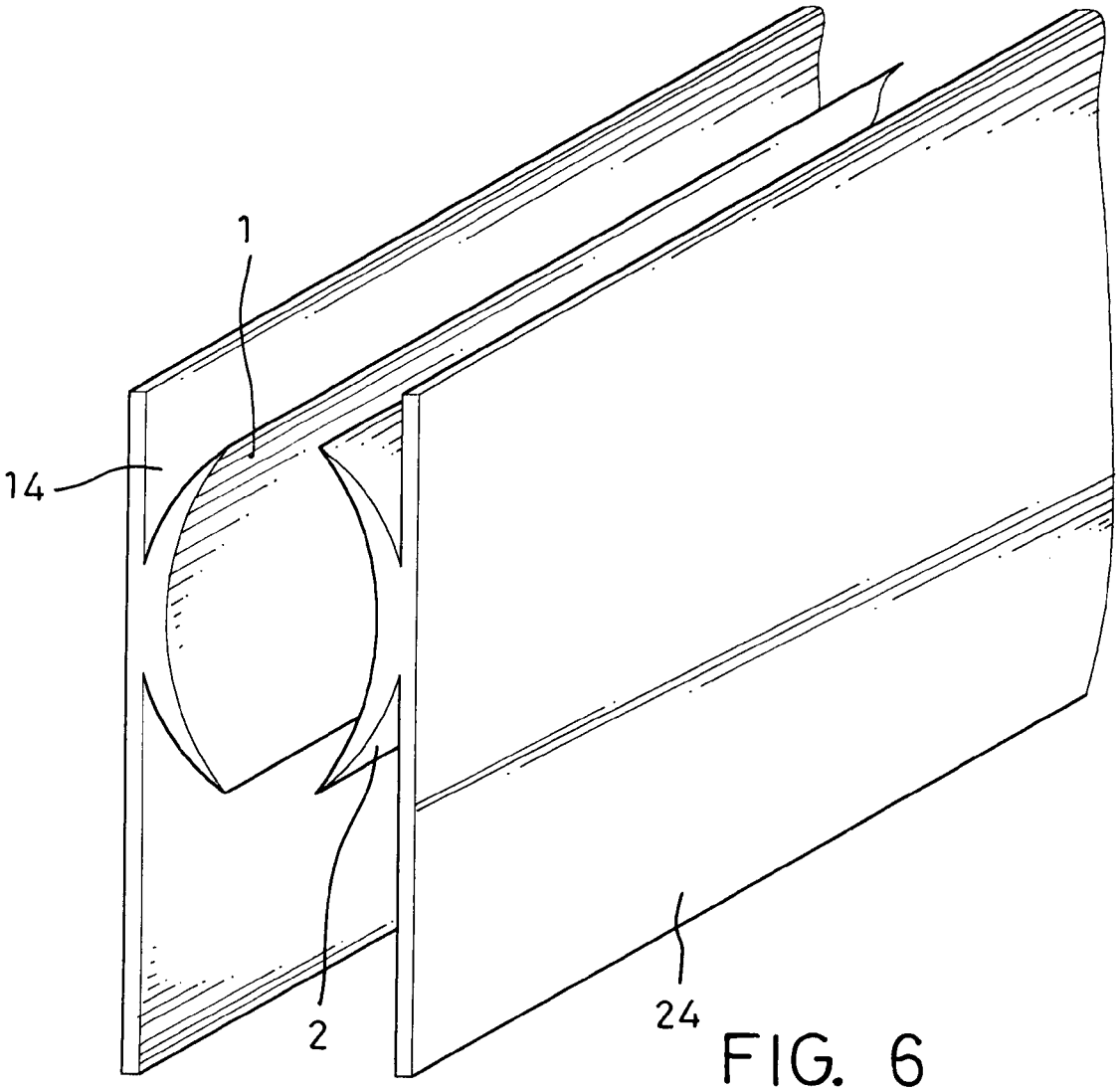
FIG. 6 is a perspective view of the shut apparatus according to the present invention illustrating vertical plates being added to outer sides thereof.

Referring to FIG. 5, the primary plate 1 and the follower plate 2 each extend outward a connecting plate 13, 23 from the central positions of the outer sides thereof in a way of the connecting plates being perpendicular to the primary plate 1 and the follower plate 2 respectively. The connecting plates 13, 23 are used for external connection. FIG. 6 shows the primary plate 1 and the follower plate 2 each extend vertically an extension plate 14, 24 from the central positions of the outer sides thereof respectively for external connection.

Figure 7:
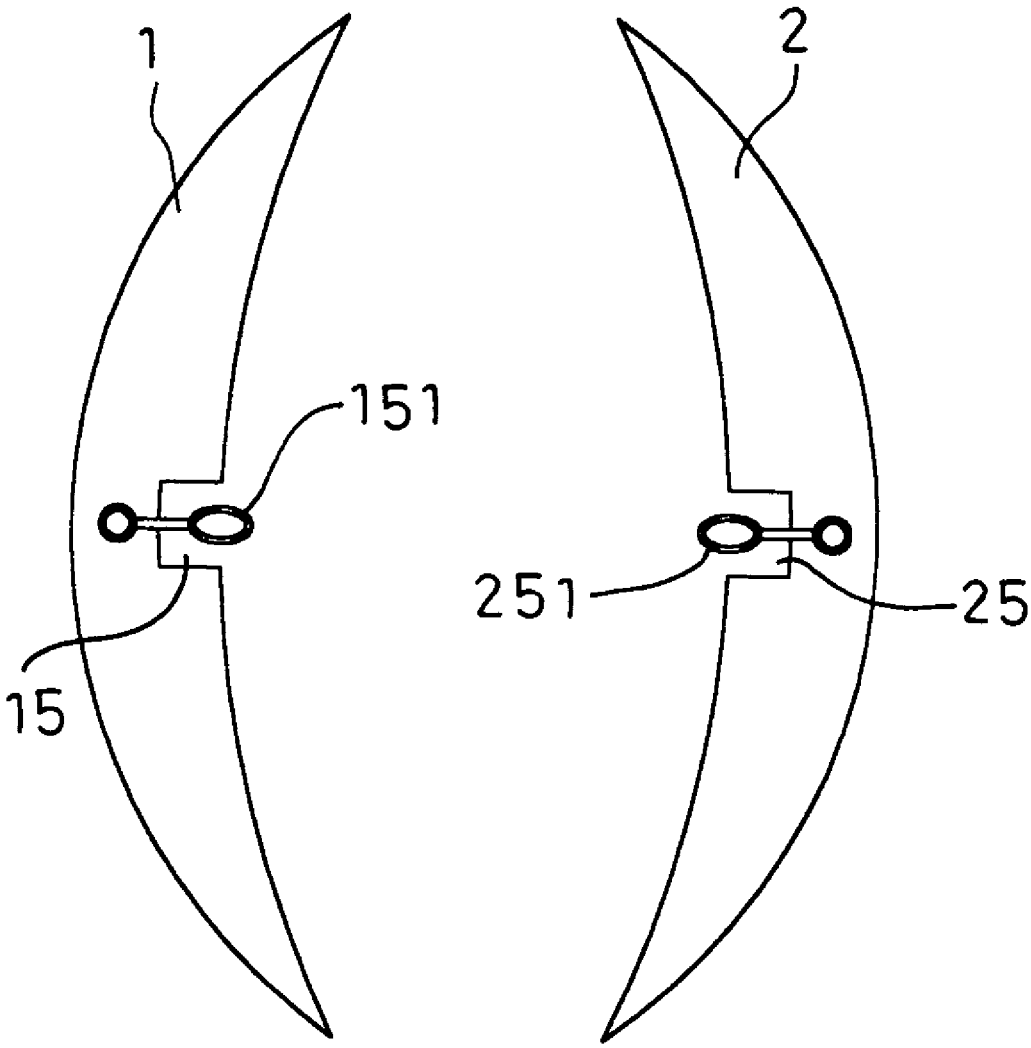
FIG. 7 is a plan view of the shut apparatus according to the present invention illustrating at inner sides thereof being added with fastener.

Referring to FIG. 7, the primary plate 1 and the follower plate 2 each at the inner sides thereof are provided with a recess shaped chamber 15, 25 respectively to be joined to fastener 151, 251. In this way, a shut apparatus with zipper is formed.

Figures 1, 8:
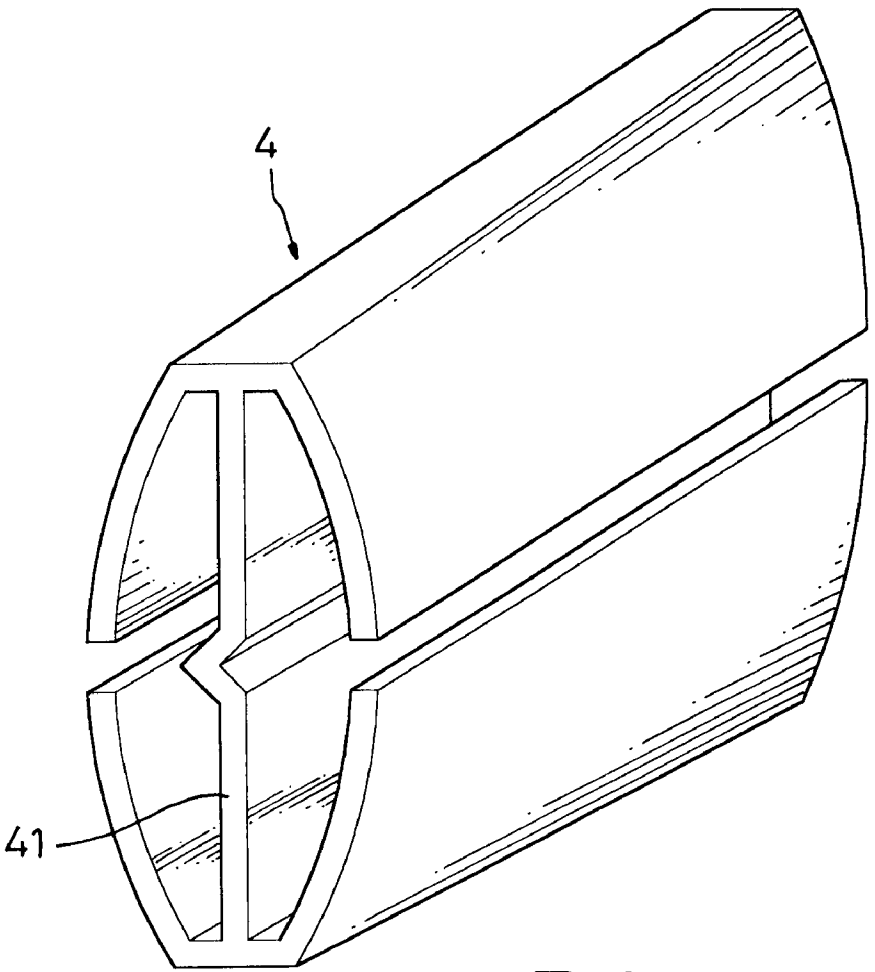
Figures 2, 8:
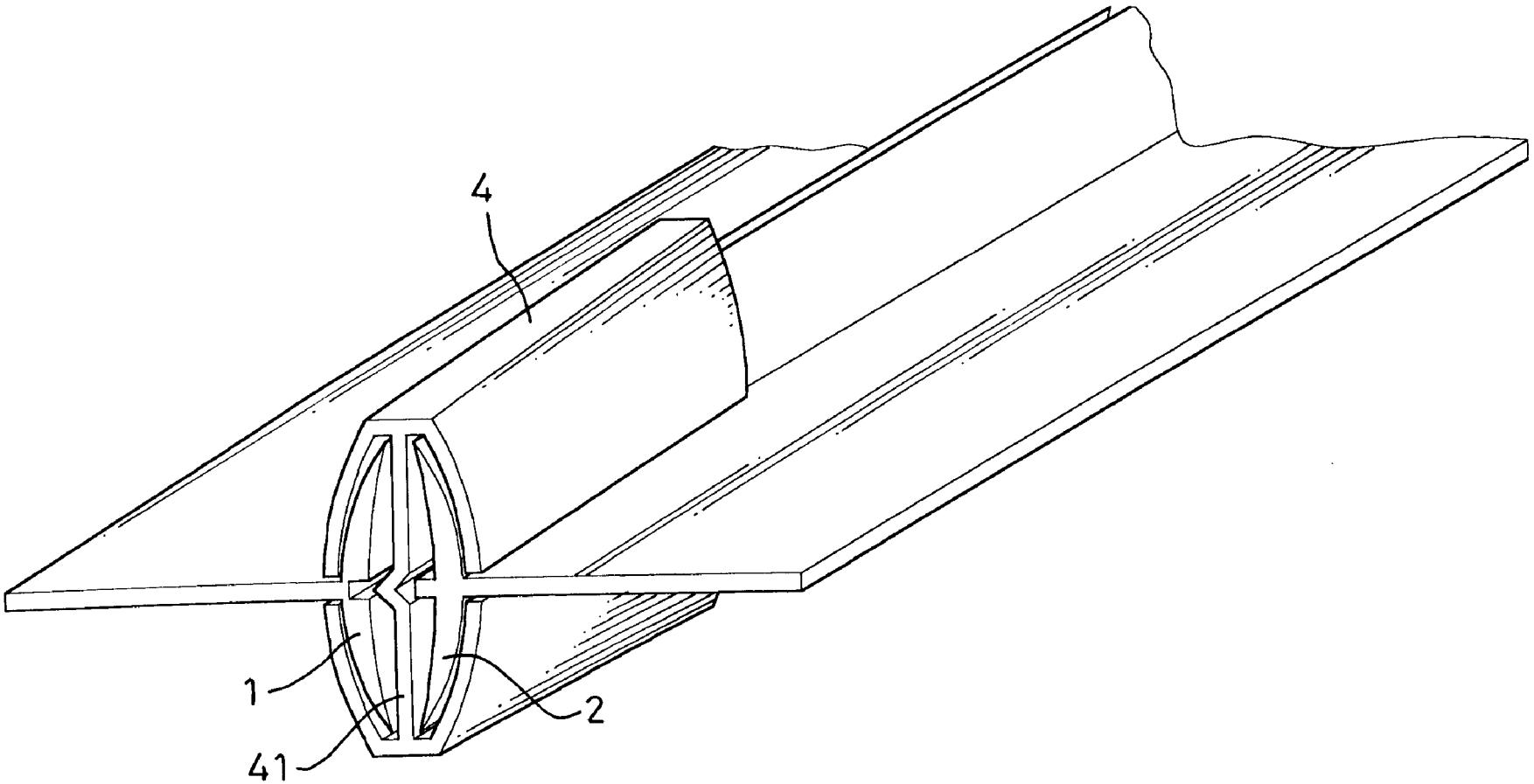

Referring to FIGS. 8-1 and 8-2, a driving device for the shut apparatus is added. A slider 4 is illustrated in FIG. 8-1 for enclosing the primary plate 1 and the follower plate 2. The slider 4 at the central position thereof has a vertical push arm 41 such that once the slider 4 fits with the primary plate 1 and the follower plate 2, the slider 4 can be actuated to slide along the two plates 1, 2 and the two plates 1, 2 can tightly join to each other at the part being passed by the slider 4. Similarly, the slider 4 at the front end thereof can be actuated to push the two joined plates 1, 2 open to form a state of separation.

It is appreciated that the primary plate 1 and the follower plate 2 arranged in the shut apparatus of the present invention can provide an effect of airtight during contacting together and it is very effective for preventing from humidity. Further, the shut apparatus can be made of cheap soft high molecular material to effectively meet the requirement of the airtight and the water resistance.

While the invention has been described with reference to a preferred embodiment thereof, it is to be understood that modifications or variations may be easily made without departing from the spirit of this invention, which is defined by the appended claims.

What is claimed is:

1. An elongated shut apparatus comprising:

a) a primary plate having a crescent shaped cross section defined by two tapered primary lateral ends on either side of a thicker primary middle section, the primary plate having interior and exterior surfaces tapering to opposed ends; and b) a follower plate having a crescent shaped cross section defined by two tapered follower lateral ends on either side of a thicker follower middle section, the follower plate having interior and exterior surfaces tapering to opposed ends, wherein the interior surface of the primary plate faces the interior surface of the follower plate, wherein the primary plate has a first engaging element extending along a center of the interior surface thereof and the follower plate has a second engaging element extending along a center of the interior surface thereof, the first engaging element engaging the second engaging element.

2. The shut apparatus according to claim 1, further comprising a handle plate connected to a lateral edge of one of the primary plate and the follower plate.

3. The shut apparatus according to claim 1, further comprising a plate connected to a center of the exterior surface of one of the primary plate and the follower plate.

4. The shut apparatus according to claim 1, wherein the first engaging element is a tenon and the second engaging element is a groove.

5. The shut apparatus according to claim 1, wherein the first engaging element is a groove and the second engaging element is a tenon.

6. The shut apparatus according to claim 1, wherein the primary plate has a first wing extending along a center of the interior surface thereof and the follower plate has a second wing extending along a center of the interior surface thereof, the first wing contacting the second wing.

7. The shut apparatus according to claim 6, wherein the first wing has a first engaging element and the second wing has a second engaging element, the first and the second engaging elements are selected from a tenon and a groove.

8. The shut apparatus according to claim 1, wherein the primary plate has a first recess chamber with a first fastener extending along a center of the interior surface thereof and the follower plate has a second recess chamber with a second fastener extending along a center of the interior surface thereof, the first fastener and the second fastener meshing together.

9. The shut apparatus according to claim 1, further comprising a slider movable along the primary plate and the follower plate, and having a central push arm.

10. The shut apparatus according to claim 1, wherein the primary plate and the follower plate are configured to adhere to one another when the shut apparatus is closed.

* * * * *